US008647130B2

(12) United States Patent
Toki et al.

(10) Patent No.: US 8,647,130 B2
(45) Date of Patent: Feb. 11, 2014

(54) WIRING DUCT CONNECTION DEVICE

(75) Inventors: Masato Toki, Mie (JP); Yukihiro Matsunobu, Mie (JP); Shinichiro Yano, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/449,556

(22) Filed: Apr. 18, 2012

(65) Prior Publication Data

US 2012/0264338 A1 Oct. 18, 2012

(30) Foreign Application Priority Data

Apr. 18, 2011 (JP) ..... 2011-092316

(51) Int. Cl.
*H01R 25/00* (2006.01)

(52) U.S. Cl.
USPC ..... 439/121

(58) Field of Classification Search
USPC ..... 439/110, 122, 121, 117, 116, 118
See application file for complete search history.

(56) References Cited

U.S. PATENT DOCUMENTS

| | | | | |
|---|---|---|---|---|
| 4,217,018 | A * | 8/1980 | Yoshida et al. | 439/118 |
| 5,478,261 | A * | 12/1995 | Bogese, II | 439/676 |
| 5,936,418 | A * | 8/1999 | Ideta et al. | 324/756.02 |
| 7,798,824 | B2 * | 9/2010 | Fong | 439/116 |

FOREIGN PATENT DOCUMENTS

| | | |
|---|---|---|
| JP | 2002-199544 | 7/2002 |
| JP | 4088441 | 5/2008 |
| JP | 2009-283423 | 12/2009 |

* cited by examiner

*Primary Examiner* — Phuong Dinh
(74) *Attorney, Agent, or Firm* — Bacon & Thomas, PLLC

(57) ABSTRACT

A wiring duct connection device includes a connection body to be inserted into an end portion of a wiring duct having conductors arranged on side walls within an elongated grove-like core along a longitudinal direction; contactors held in the connection body in such a manner that the contactors can protrude from opposite side surfaces of the connection body; and elastic bodies which biases the contactors outward. The elastic bodies are arranged side by side along the longitudinal direction at an inner side of each of the contactors, and each of the contactors includes convex contact portions that are one-piece formed at an outer end thereof, the contact portions being arranged along the longitudinal direction.

11 Claims, 8 Drawing Sheets

WIRING DUCT CONNECTION DEVICE

FIELD OF THE INVENTION

The present invention relates to a wiring duct connection device connected to an end portion of a wiring duct.

BACKGROUND OF THE INVENTION

A wiring duct connection device is conventionally used to lead a power supply to a wiring duct 100 as shown in FIG. 9 or to electrically connect wiring ducts together. For example, Japanese Patent. No. 4088441 (JP4088441B) discloses a wiring duct connection device having a structure shown in FIG. 8. The wiring duct connection device includes a connection body 1 inserted into an end portion of a wiring duct 100, a pair of contactors 2 protruding outward from the connection body portion 1, a pair of elongated flat conductor members 200 for resiliently supporting the contactors 2 and a pair terminal blocks 4 electrically connected to the contactors 2 through the conductor members 200. When the connection body 1 is inserted into the wiring duct 100, the contactors 2 are electrically connected to the conductors 110 of the wiring duct 100.

The wiring duct connection device shown in FIG. 8 has a structure in which only one contactor 2 makes contact with each of the conductors 110 of the wiring duct 100. This poses a problem in terms of the contact reliability.

In light of this, Japanese Patent Application Publication No. 2009-283423 (JP2009-283423A) proposes a wiring duct connection device in which a pair of contactors is arranged side by side along a longitudinal direction so as to independently make contact with each of the conductors 110 of the wiring duct 100. Each of the contactors is resiliently supported by an elongated flat conductor member and is electrically connected to a terminal block through the conductor member.

With this wiring duct connection device, the contactors make contact with each of the conductors 110 at two points. This makes it possible to enhance the contact reliability as compared with the wiring duct connection device shown in FIG. 8.

In the wiring duct connection device disclosed in JP2009-283423A, however, each of the contactors arranged side by side along the longitudinal direction needs to be electrically connected to the terminal block through the conductor member. This leads to an increase in the number of electric connection points within the connection body portion, in proportion to which the reliability becomes lower. Moreover, there is a need to prepare a multiple number of contactors because the contactors are arranged side by side along the longitudinal direction. This poses a problem of increased cost.

SUMMARY OF THE INVENTION

In view of the above, the present invention provides a wiring duct connection device capable of increasing the number of points making contact with each conductor of a wiring duct to two or more and consequently enhancing the reliability of electric connection, while suppressing an increase in cost.

In accordance with one aspect of the present invention, there is provided a wiring duct connection device, including: a connection body to be inserted into an end portion of a wiring duct having conductors arranged on side wails within an elongated grove-like core along a longitudinal direction; contactors held in the connection body in such a manner that the contactors can protrude from opposite side surfaces of the connection body; and elastic bodies which biases the contactors outward, wherein the elastic bodies are arranged side by side along the longitudinal direction at an inner side of each of the contactors, and wherein each of the contactors includes convex contact portions that are one-piece formed at an outer end thereof, the contact portions being arranged along the longitudinal direction.

Preferably, each of the contactors may have push areas pressed outward by the corresponding elastic body, the push areas being arranged with a distance therebetween along the longitudinal direction, and wherein the distance between the push areas existing at opposite ends among the push areas arranged site by side along the longitudinal direction being is set smaller than a distance between the contact portions existing at opposite ends among the contact portions arranged side by side along the longitudinal direction.

Preferably, each of the contactors may have push areas pressed outward by the corresponding elastic body, the push areas being arranged with a distance therebetween along the longitudinal direction, and wherein the push areas lying side by side along the longitudinal direction and the contact portions lying side by side along the longitudinal direction being are arranged in an axial symmetry with respect to a common centerline.

Preferably, each of the contactors may include a salient portion formed at an inner end thereof to extend from the push areas in a direction orthogonal to the longitudinal direction.

Preferably, the connection body may have a fixing hole for fixing the connection body to the wiring duct, the fixing hole being formed to lie inward of longitudinal midpoints between the contact portions, of the contactors.

Preferably, each of the elastic bodies may be formed of a single leaf spring member, and wherein the leaf spring member has at the longitudinal opposite ends thereof U-like bent portions and spring portions extending from the bent portions, the spring portions being brought into contact with the push areas. Further, each of the elastic bodies may be formed of two or more leaf spring members, and wherein each of the leaf spring members has a U-like bent portion and a spring portion extending from the bent portion, the spring portion being brought into contact with the corresponding push area.

Preferably, each of the spring portions may include a first portion obliquely extending inward from of the corresponding bent portion and a second portion obliquely extending outward from the first portion, the second portion having a tip end making contact with each of the push areas.

Preferably, the connection body may include two tip end portions to be inserted into the core of the wiring duct, the two tip end portions being arranged at the opposite sides thereof along the longitudinal, direction, and wherein the contactors arranged in one of the tip end portions and the contactors arranged in the other tip end portion are electrically connected to each other by flexible electric conductors, respectively.

The present invention provides an effect of increasing the number of points making contact with each conductor of a wiring duct to two or more and consequently enhancing the reliability of electric connection, while suppressing an increase in cost.

DETAILED DESCRIPTION OF THE PREFERRED. EMBODIMENTS

Embodiments of she present invention will now be described with reference to the accompanying drawings which form a part hereof.

Figure 1:
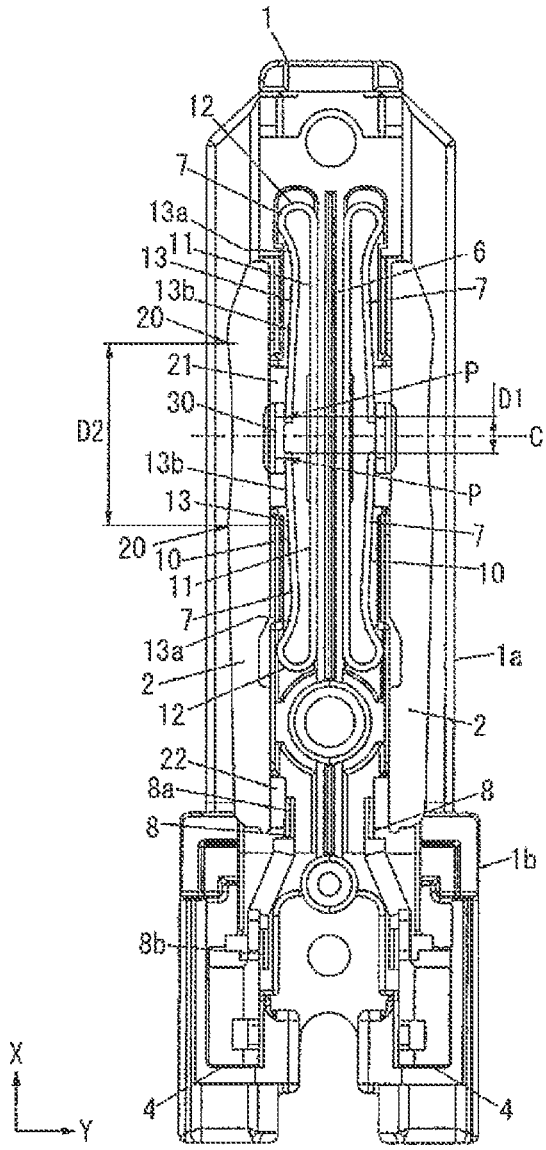
FIG. 1 is a front view showing the internal structure of a wiring duct connection device according to a first embodiment of the present invention.

FIG. 1 shows a wiring duct connection device in accordance with a first embodiment of the present invention. Just like the wiring duct connection devices disclosed in JP4088441B and JP2009-283423A, the wiring duct connection device of the present embodiment is mounted to the wiring duct 100 when in use. The wiring duct connection device disclosed herein is embodied as a feed-in cap for feeding electric power to the conductors 110 of the wiring duct 100.

First, description will be made in detail on the structure of the wiring duct 100.

Figure 9:
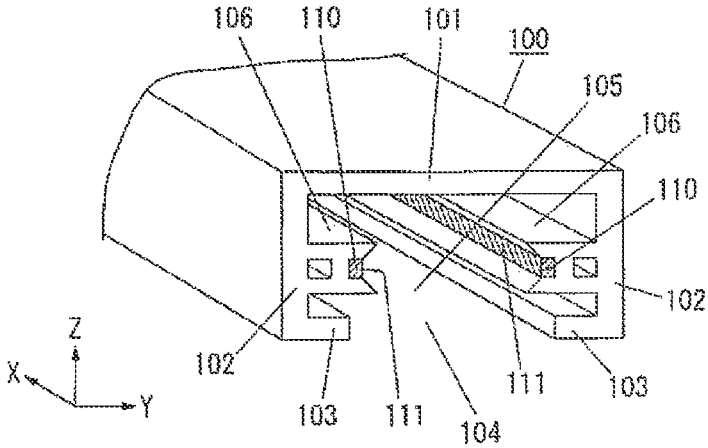
FIG. 9 is a perspective view showing a wiring duct.

As shown in FIG. 9, the wiring duct 100 is an elongated tubular member in which the cross section perpendicular to the longitudinal direction X is formed into a generally inverted U-like shape to have a lip. The wiring duct 100 includes an upper wall 101, a pair of side walls 102 extending from the opposite lateral ends of the upper wall 101 and a pair of bottom walls 103 extending from the tip ends of the respective side walls 102 to form lip portions. The gap between the bottom walls 103 as lip portions becomes an opening 104 through which the inside and outside of the wiring duct 100 communicate with each other. The wiring duct 100 is arranged so that the opening 104 can face downward. The space inward of the opening 104 becomes an elongated groove-like core 105.

Conductor holding portions 106 are formed on the inner surfaces of the side walls 102 to protrude inward. Conductors 110 are fixed to leading end portions of the conductor holding portions 106. The conductors 110 are arranged to extend along the longitudinal direction X. The conductors 110 have linearly-extending planar connection surfaces 111 of elongated rectangular shape, which are exposed toward the inside of the core 105. The connection surfaces 111 of the conductors 110 are arranged at the same height so as to face with each other through the core 105.

Next, description will be made in detail on the structure of the wiring duct connection device of the present embodiment mounted to the wiring duct 100.

Referring to FIG. 1, the wiring duct connection device of the present embodiment includes a connection body 1 for accommodating the individual components to be described later. The connection body 1 is divided into a tip end portion 1*a* and a base end portion 1*b* a little wider than the tip end portion 1*a*. The tip end portion 1*a* is inserted into the core 105 through the end opening of the wiring duct 100. A pair of contactors 2 having an elongated flat shape as a whole is provided in the tip end portion 1*a* so that the contactors 2 can protrude outward from the opposite lateral surfaces of the tip end portion 1*a* within a predetermined extent.

Terminal blocks 4, to which the contactors 2 are electrically connected, are arranged in the base end portion 1*b* of the connection body 1. When the tip end portion 1*a* of the connection body 1 is inserted into the core 105 of the wiring duct 100, each of the contactors 2 makes resilient contact with the corresponding one of the conductors 110 at two points. Thus the contactors 2 and the conductors 110 are electrically connected to each other in a one-to-one correspondence.

The respective configurations of the wiring duct connection device will now be described in more detail.

In the opposite lateral portions of the connection body 1, there are provided openings through which the contactors 2 can protrude and retract. A partition wall 6 for keeping the contactors 2 from making contact with each other is formed within the connection body 1 to extend along the longitudinal direction X. Elastic bodies 7 for making contact with the contactors 2 and applying outward biasing forces to the contactors 2 are arranged between the partition wall 6 positioned at the center in the transverse direction Y and the contactors 2 adjoining to the partition wall 6.

In this regard, the transverse direction Y is orthogonal to the longitudinal direction Y. The longitudinal direction X used in describing the connection body 1 coincides with the longitudinal direction K used in explaining the wiring duct 100.

The elastic bodies 7 serve to independently apply resilient forces to the contactors 2. The elastic bodies 7 are arranged in plural numbers (in a pair in the present embodiment) inside each of the contactors 2. The elastic bodies 7 forming a pair are arranged side by side along the longitudinal direction X to make a single line.

The elastic bodies 7 forming a pair are designed to independently apply biasing forces to the contactors 2. In the present embodiment, as will be described below, the elastic bodies 7 forming a pair are partially connected to each other to make up a single member.

In the present embodiment, the elastic bodies 7 arranged side by side along the longitudinal direction K are made up of a leaf spring member 10 bent at the opposite ends thereof. The leaf spring member 10 includes a straight support portion 11, a pair of bent portions 12 extending from the opposite ends of the support portion 11 in a U-like shape and a pair of spring portions 13 extending from the tip ends of the bent portions 12.

Each of the spring portions 13 includes a first portion 13*a* and a second portion 13*b* which are different in slope and are formed into a continuously-extending substantially chevron-like shape. The first portion 13*a* is a straight elastic piece obliquely extending inward from the tip end of each of bent portions 12. The second portion 13*b* is a straight elastic piece obliquely extending outward from the tip end of the first portion 13*a*. The tip end of the second portion 13*b* comes into contact with a target push area P, thereby applying a resilient biasing force to the corresponding contactor 2.

In other words, each of the elastic bodies 7 includes the support portion 11, the bent portion 12 and the spring portion 13 and has a generally U-like shape. One leaf spring member 10 is formed by unifying the support portions 11 of the elastic bodies 7 adjoining to each other in the longitudinal direction X.

FIG. 15 shows a modified example of the leaf spring member 10. In his modified example, each of the spring portions 13 is formed into a straight line shape. In other words, the leaf spring member 10 of the modified example includes a straight support portion 11, a pair of U-like bent portions 12 extending from the opposite ends of the support portion 11 and a pair of straight spring portions 13 extending toward each other from the tip ends of the bent portions 12. Use of the leaf spring member 10 of the modified example makes it possible to form the elastic bodies 7 into a single piece.

Figure 5:
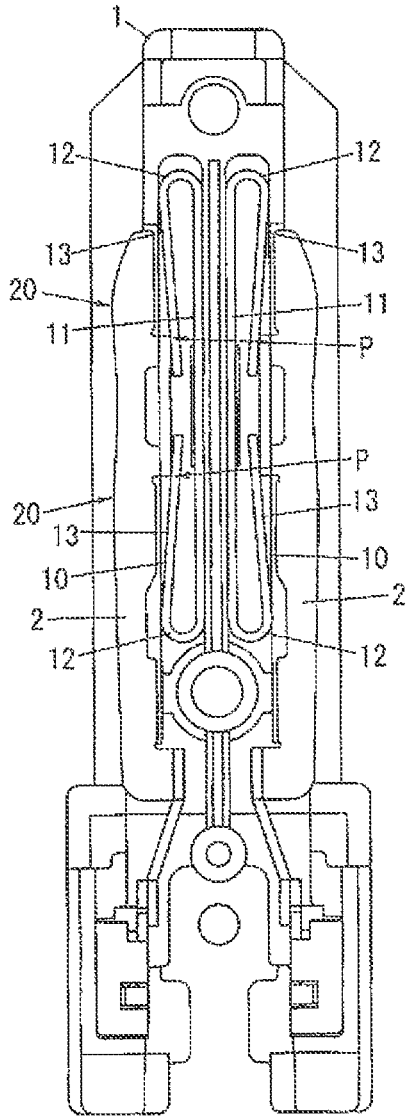
FIG. 5 is a front showing the wiring duct connection device according to the first embodiment, which is provided with a modified example of a spring member.

As compared with the leaf spring member 10 of the modified example shown in FIG. 5, the leaf spring member 10 having the shape shown in FIG. 1 provides an advantage in that the positions of the contact portions (the push area P) between the spring portions 13 and the contactors 2 can be stabilized with ease and an advantage in that an increased resilient force can be easily generated with a reduced displacement.

Figure 4A:
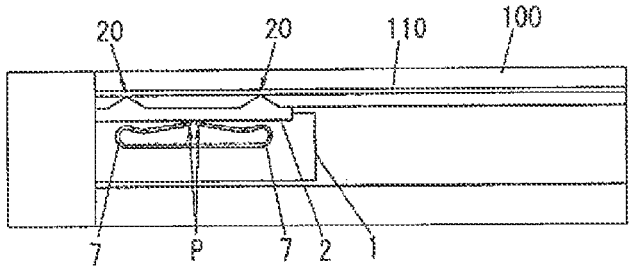
FIG. 4A is a schematic diagram showing a state in which the wiring duct connection device according to the first embodiment is mounted to a wiring duct with no tilt and FIG. 4B is a schematic diagram showing a state in which the wiring duct connection device according to the first embodiment is mounted to the wiring duct in a tilted condition.
Figure 4B:
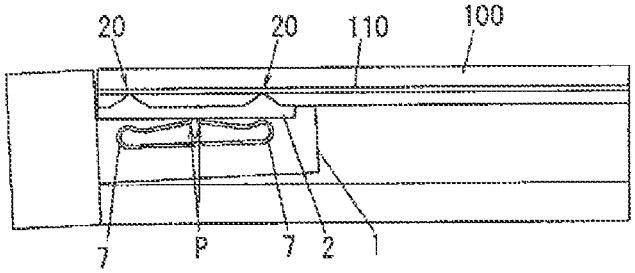

Each of the contactors 2 includes a plurality of (a pair of, in the present embodiment) convex contact portions 20 formed at the outer end thereof. Each of the contact portions 20 has a contour gently bulging outward and makes contact (namely, point-to-point contact) with each of the conductors 110 of the wiring duct 100 at the outermost point of the contour (see FIG. 4). In other words, each of the contactors 2 includes a pair of contact portions 20 formed by outwardly expanding two points of the outer edge extending in the longitudinal direction X. The contact portions 20 are one-piece formed with each other.

Figure 2:
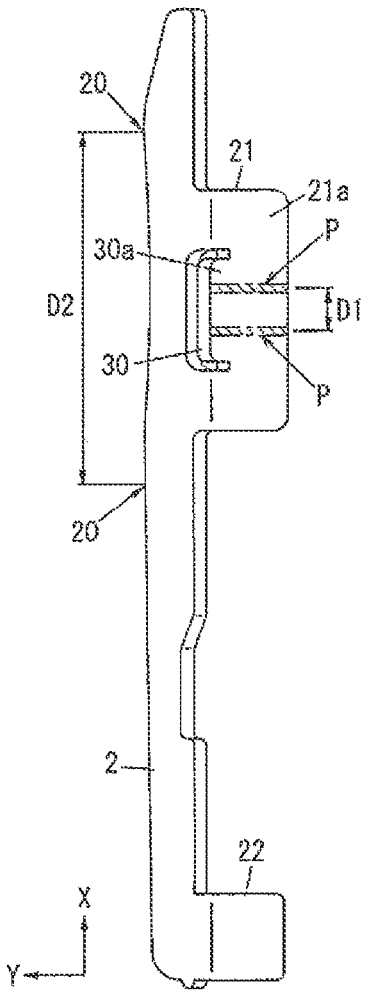
FIG. 2 is a perspective view illustrating a contactor employed in the wiring duct connection device according to the first embodiment.

Referring to FIG. 2, a rest portion 21 is formed in a bent shape at the inner end of each of the contactors 2. The rest portion 21 is a flake-shaped portion extending in the direction parallel, to the thickness direction Z. The thickness direction Z is orthogonal to the longitudinal direction X and the transverse direction Y. The rest portion 21 is bent into an L-like shape and is provided with a planar surface 21*a* facing inward. The tip ends of the spring portions 13 of the elastic bodies 7 are pressed against different points on the planar surface 21*a*.

Consequently, the elastic bodies 7 resiliently press the corresponding one of the contactors 2 outward, thereby causing the contact portions 20 of each of the contactors 2 to make resilient contact with each of the conductors 110 of the wiring duct 100.

The contactors 2 and the terminal blocks 4 of the connection body 1 are electrically connected to each other through flexible electric conductors 8 which are formed of electric wires. Each of the electric conductors 8 has a first end portion 8*a* mechanically and electrically connected to a bent connection portion 22 of each of the contactors 2. The connection portion 22 is formed by bending the end portion of each of the contactors 2 nearer to the corresponding terminal block 4 into an L-like shape so extend in the same direction as the rest portion 21. Each of the electric conductors 8 has a second end portion 8*b* mechanically and electrically connected to the corresponding one of the terminal blocks 4.

Each of the contactors 2 has push areas P (the hatched areas in FIG. 2) with which the tip ends of the spring portions 13 of the elastic bodies 7 make contact. The push areas P are spaced apart from each other and are defined in a corresponding relationship with the respective elastic bodies 7. The push areas P exist at two points on the planar surface 21*a* of the rest portion 21. The two push areas P are arranged side by side with distance D1 left therebetween along the longitudinal direction X.

The distance D1 between the push areas P is set smaller than the distance D2 between the contact portions 20 of each of the contactors 2. The distance D2 between the contact portions 20 referred to herein denotes the distance along the longitudinal direction X between the outermost points of the contact portions 20.

The push areas P lying side by side along the longitudinal direction X and the contact portions 20 lying side by side along the longitudinal direction X are respectively arranged in an axial symmetry with respect to the common centerline C. The centerline C is an imaginary line extending in the direction orthogonal to the longitudinal direction X (see FIG. 1).

In each of the contactors 2, the push areas P pressed by the elastic bodies 7 and the contact portions 20 making resilient contact with each of the conductors 110 of the wiring duct 100 are respectively arranged in an axial symmetry with respect to the common centerline C. The distance D1 between the push areas P is set smaller than the distance D2 between the contact portions 20.

With this axial symmetry arrangement, it is possible to restrain generation of a deviation in the loads applied to the push areas P or the contact portions 20 of each of the contactors 2 when the connection body 1 is inserted into and connected to the wiring duct 100. Since the distance D1 between the push areas P is set small, it is possible to reduce, as far as possible, the deviation in the loads applied to the push areas P or she contact portions 20, even when the connection body 1 is connected to the wiring duct 100 in a slightly tilted state (see FIG. 4B).

The centerline C is set to pass through the midpoint of the tip end portion 1*a* of the connection body 1 in the longitudinal direction X. With this setting of the centerline C, it is possible to restrain generation of a deviation in the loads applied to the push areas P or the contact portions 20 when the connection body 1 is connected to the wiring duct 100 in a tilted state. Preferably, the midpoints between the contact portions 20 of both of the contactors 2 in the longitudinal direction X are brought into alignment with the midpoint of the longitudinal dimension of the tip end portion 1*a*.

In each of the contactors 2 of the present embodiment, a salient portion 30 protruding in the thickness direction Z is provided in the longitudinal center region of the rest portion 21 formed at the inner end of each of the contactors 2. The salient portion 30 has an inwardly-facing planar surface 30*a* (see FIG. 2) extending flush with the central region of the planar surface 21*a* of the rest portion 21 in the thickness direction Z.

The push areas P of each of the contactors 2 are linearly formed to extend from the planar surface 21*a* of the rest portion 21 to the planar surface 30*a* of the salient portion 30. In other words, the salient portion 30 is extended from the push areas P along the thickness direction Z.

Figure 3:
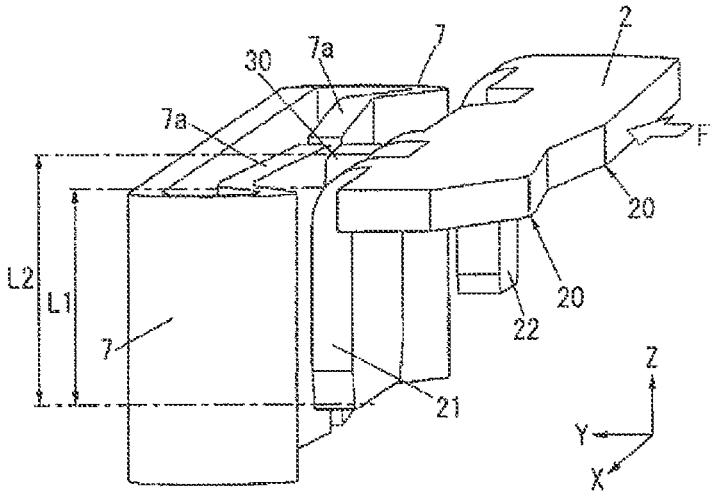
FIG. 3 is a perspective view depicting a state in which the contactor is pressed against an elastic body.

In a hypothetical case that the salient portion 30 is not formed, the length of the push areas P in the thickness direction Z is equal to L1 as shown in FIG. 3. In the present embodiment, however, the length of the push areas P in the thickness direction Z becomes equal to L2 (>L1) because the salient portion 30 is formed in each of the contactors 2. Consequently, as compared with a case where the salient portion 30 is not formed, it is less likely that a tilt is generated in each of the contactors 2 when a load is applied to each of the contactors 2 as indicated by an arrow F in FIG. 3.

In this regard, the protruding direction of the salient portion 30 is opposite to the direction in which the rest portion 21 is bent into an L-like shape. This makes it possible to more effectively restrain generation of a tilt in each of the contactors 2 when a load is applied to each of the contactors 2 as indicated by the arrow F.

Figure 6:
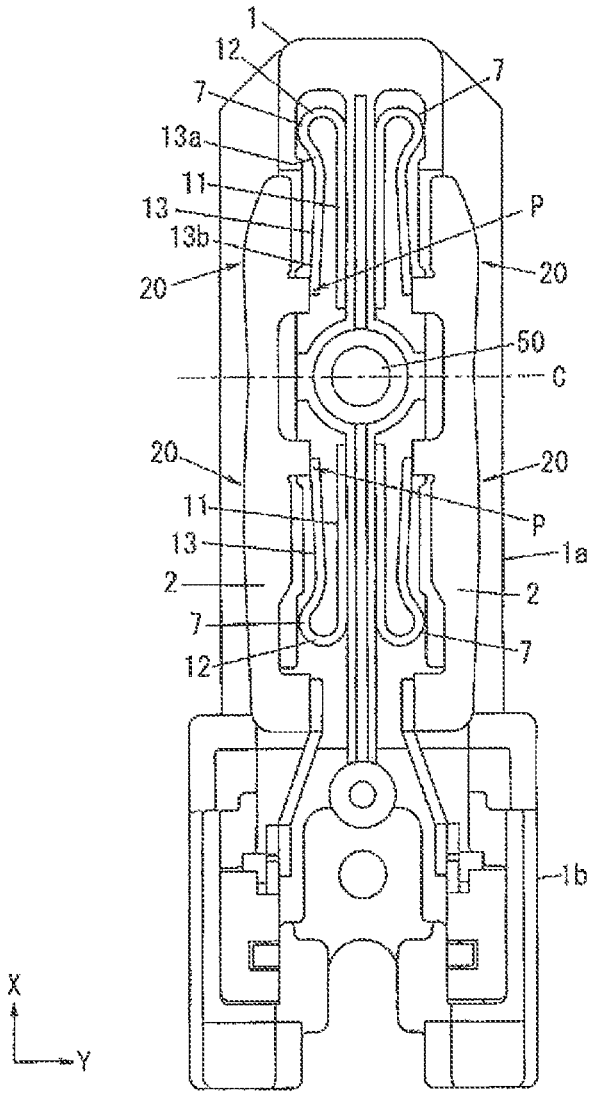
FIG. 6 is a front view showing the internal structure of a wiring duct connection device according to a second embodiment of the present invention.

Next, a wiring duct connection device in accordance with a second embodiment of the present invention will be described with reference to FIG. 6. No detailed description will be made on same configurations as those of the first embodiment. The characteristic configurations of the present embodiment differing from those of the first embodiment will now be described in detail.

In the wiring duct connection device of the present embodiment, a fixing hole 50 for fixing the connection body 1 to the wiring duct 100 is formed in the central region of the tip end portion 1*a*. In this connection, the central region refers to a region centrally positioned in the longitudinal direction X and the transverse direction Y. The fixing hole 50 extending in the thickness direction Z is formed in this central region. A fixing screw (not shown) is inserted into the fixing hole 50 to thereby fix the connection body 1 to the wiring duct 100.

More specifically, the center of the fixing hole 50 having a circular shape is positioned ac the midpoint of a line segment, i.e., an imaginary line (the centerline C stated above), which interconnects the midpoint between the contact portions 20 of one of the contactors 2 and the midpoint between the contact portions 20 of the other contactor 2.

In this manner, the fixing hole 50 is positioned inward of the longitudinal midpoints between the contact portions 20 of the respective contactors 2. Therefore, even if a tilt is generated in the connection body 1 when the connection body 1 is fixed to the wiring duct 100 by a fixing screw, it is possible to restrain, as far as possible, generation of a deviation in the loads applied to the respective contact portions 20.

Due to the formation of the fixing hole 50 in the central region, the elastic bodies 7 are not formed into a single member in the present embodiment. In other words, the support portion 11 of the leaf spring member 10 of the first embodiment is exactly severed into two members in the region where the fixing hole 50 exists.

More specifically, each of the elastic bodies 7 is formed of a leaf spring member bent into a generally U-like shape. Each of the elastic bodies 7 includes a straight support portion 11, a U-like bent portion 12 extending from one end of the support portion 11 and a spring portion 13 extending from the tip end of the bent portion 12. Dust like the first embodiment, the spring portion 13 includes a first portion 13*a* and a second portion 13*b* which are formed into a continuously-extending substantially chevron-like shape. Since four push areas P exist in the present embodiment, four elastic bodies 7 are arranged within the connection body 1 in a one-to-one correspondence to the push areas P.

Figure 7:
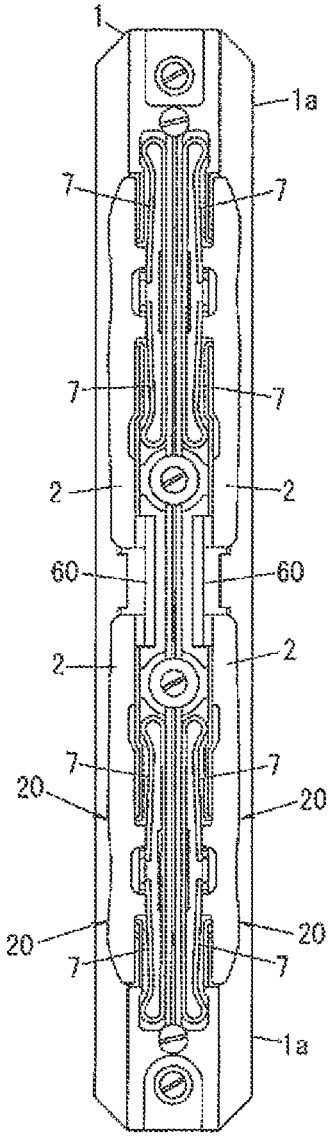
FIG. 7 is a front view showing the internal structure of a wiring duct connection device according to a third embodiment of the present invention.
Figure 8:
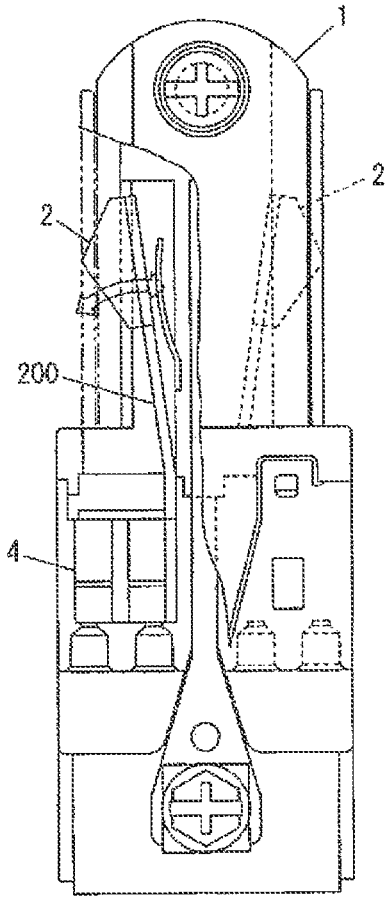
FIG. 8 is an explanatory view showing a conventional wiring duct connection device.

Next, a wiring duct connection device in accordance with a third embodiment of the present invention will be described with reference to FIG. 7. No detailed description will be made on same configurations as those of the first embodiment. The characteristic configurations of the present embodiment differing from those of the first embodiment will now be described in detail.

In the wiring duct connection device of the present embodiment, the connection body 1 includes two tip end portions 1*a* arranged at the opposite sides along the longitudinal direction X and designed to be inserted into the core 105 of the wiring duct 100. In other words, the wiring duct connection device of the present embodiment is not a feed-in cap which is employed in the first example but a feed-in joiner for electrically joining two wiring ducts 100.

Within the connection body 1, the contactors 2 are arranged side by side along the longitudinal direction X in one of the tip end portions 1*a* and the contactors 2 arranged side by side along the longitudinal direction X in the other tip end portion 1*a* are electrically connected to each other by flexible electric conductors 60, respectively.

As described above, the wiring duct connection devices in accordance with the first through third embodiments include the connection body 1 to be inserted into the end portion of the wiring duct 100 having the conductors 110 arranged on the side walls 102 within the elongated grove-like 105 along the longitudinal direction X, the contactors 2 held in the connection body 1 in such a manner that the contactors 2 can protrude from the opposite side surfaces of the connection body 1, and the elastic bodies 7 for biasing the contactors 2 outward. The elastic bodies 7 are arranged side by side along the longitudinal direction X at the inner sides of the corresponding contactors 2. The convex contact portions 20 are one-piece formed on the outer ends of the contactors 2 and are arranged side by side along the longitudinal direction X.

With the wiring duct connection devices of the foregoing embodiments, the points making contact with each of the conductors 110 of the wiring duct 100 are provided in plural numbers. It is therefore possible to stabilize the electric connection between the contactors 2 and the conductors 110. The contact portions 20 are one-piece formed with the contactors 2. Accordingly, the electric connection within the connection body 1 needs only to be performed with respect to the contactors 2. There is no need to perform the electric connection to each of the contact portions 20. This makes it possible to restrain an increase in the number of electric connection points within the connection body 1, thereby maintaining the reliability of electric connection. Since there is no need to prepare the contactors 2 in plural numbers, it is possible to reduce the costs.

In the wiring duct connection devices in accordance with the first through third embodiments, each of the contactors 2 has the push areas P pressed outward by the elastic bodies 7. The push areas P independently provided with respect to each of the elastic bodies 7 with a distance left therebetween. The distance D1 between the push areas P existing at the opposite ends among the push areas P arranged side by side along the longitudinal direction X (the distance between a pair of push areas P in the foregoing embodiments) is set smaller than a distance D2 between the contact portions 20 existing at the opposite ends among the contact portions 20 arranged side by side along the longitudinal direction X (the distance between a pair of contact portions 20 in the foregoing embodiments).

In this manner, the push areas P of each of the contactors 2 are arranged as close as possible. Therefore, even if the connection body 1 is inserted into the wiring duct 100 in a tilted state, it is possible to restrain generation of a deviation in the loads applied to the push areas P or the contact portions 20.

In the wiring duct connection devices in accordance with the first through third embodiments, each of the contactors 2 has the push areas P pressed outward by the elastic bodies 7. The push areas P are independently provided with respect to each of the elastic bodies 7 with a distance left therebetween. The push areas P lying side by side along the longitudinal direction X and the contact portions 20 lying side by side along the longitudinal direction X are arranged in an axial symmetry with respect to the common centerline C.

With this axial symmetry arrangement, it is possible to more effectively restrain generation of a deviation in the loads applied to the push areas P or the contact portions 20 of each of the contactors 2.

In the wiring duct connection devices in accordance with the first through third embodiments, the salient portion 30 for prolonging the push areas P in the direction orthogonal to the longitudinal direction X is provided at the inner end of each of the contactors 2.

By setting the length of the push areas P of the contactors 2 as large as possible, it is possible to restrain generation of a tilt in each of the contactors 2 when a load is applied to each of the contactors 2.

In the wiring duct connection device of the second embodiment, the fixing hole 50 for fixing the connection body 1 to the wiring duct 100 is formed to lie inward of the longitudinal midpoints between the contact portions 20 of the contactors 2.

With this arrangement of the fixing hole 50, it is possible to restrain generation of a deviation in the loads applied to the respective contact portions 20, even when the connection body 1 is fixed in a tilted posture by tightening a screw through the fixing hole 50. Thus the electric connection between the connection body 1 and the wiring duct 100 can be kept stable.

In the wiring duct connection devices in accordance with the first and third embodiments, the elastic bodies 7 arranged side by side along the longitudinal direction X are formed of a single leaf spring member 10. The leaf spring member 10 is provided at the longitudinal opposite ends with the U-like bent portions 12 and the spring portions 13 extending from the bent portions 12. The spring portions 13 are brought into contact with the push areas P.

By forming to elastic bodies 7 into a single member, it becomes easy to accommodate the elastic bodies 7 with a limited space inside the connection body 1 and to reduce the number of parts.

Each of the spring portions 13 includes the first portion 13*a* obliquely extending inward from each of bent portions 12 and the second portion 13*b* obliquely extending outward from the first portion 13*a*. The tip end of the second portion 13*b* is brought into contact with each of the push areas P.

In this manner, each of the spring portions 13 is formed into a substantially chevron-like shape using the first portion 13*a* and the second portion 13*b* which differ in slope from each other. This makes it possible to bring the tip end of the second portion 13*b* into stable contact with each of the push areas P of the contactors 2. Moreover, an increased resilient force can be easily generated with a reduced displacement.

In the wiring duct connection device of the third embodiment, the connection body 1 includes two tip end portions 1*a* arranged at the opposite sides thereof along the longitudinal direction X and designed to be inserted into the core 105 of the wiring duct 100. The contactors 2 arranged in one of the tip end portions 1*a* and the contactors 2 arranged in the other tip end portion 1*a* are electrically connected to each other by the flexible electric conductors 60, respectively.

With the wiring duct connection device in which the tip end portions 1*a* having the contactors 2 and the elastic bodies 7 are provided at the opposite sides along the longitudinal, direction X, it is possible to interconnect two wiring ducts 100 through the wiring duct connection device. The wiring duct connection device has high electric connection reliability and is therefore capable of suppressing an increase in cost.

While the present invention has been described using the embodiments shown in the drawings, these embodiments are presented merely for illustrative purposes. The present invention is not limited to these embodiments.

For example, the number of the elastic bodies 7 for applying biasing forces to each of the contactors 2 is not limited one pair but may be three or more. Likewise, the number of the contact portions 20 of each of the contactors 2 is not limited one pair but may be three or more. The designs of other configurations can be arbitrarily changed within the scope of the present invention. It is also possible to appropriately combine or substitute the configurations of the respective embodiments.

What is claimed is:

1. A wiring duct connection device, comprising:

a connection body to be inserted into an end portion of a wiring duct having conductors arranged on side walls within an elongated grove-like core along a longitudinal direction;

contactors held in the connection body in such a manner that the contactors can protrude from opposite side surfaces of the connection body; and elastic bodies which biases the contactors outward, wherein the elastic bodies are arranged side by side along the longitudinal direction at an inner side of each of the contactors, and wherein each of the contactors includes convex contact portions that are one-piece formed at an outer end thereof, the contact portions being arranged along the longitudinal direction.

2. The device of claim 1, wherein each of the contactors has push areas pressed outward by the corresponding elastic body, the push areas being arranged with a distance therebetween along the longitudinal direction, and wherein the distance between the push areas existing at opposite ends among the push areas arranged side by side along the longitudinal direction being is set smaller than a distance between the contact portions existing at opposite ends among the contact portions arranged side by side along the longitudinal direction.

3. The device of claim 1, wherein each of the contactors has push areas pressed outward by the corresponding elastic body, the push areas being arranged with a distance therebetween along the longitudinal direction, and wherein the push areas lying side by side along the longitudinal direction and the contact portions lying side by side along the longitudinal direction being are arranged in an axial symmetry with respect to a common centerline.

4. The device of claim 2, wherein the push areas lying side by side along the longitudinal direction and the contact portions lying side by side along the longitudinal direction being are arranged in an axial symmetry with respect to a common centerline.

5. The device of claim 2, wherein each of the contactors includes a salient portion formed at an inner end thereof to extend from the push areas in a direction orthogonal to the longitudinal direction.

6. The device of claim 1, wherein the connection body has a fixing hole for fixing the connection body to the wiring duct, the fixing hole being formed to lie inward of longitudinal midpoints between the contact portions of the contactors.

7. The device of claim 1, wherein each of the elastic bodies is formed of a single leaf spring member, and wherein the leaf spring member has at the longitudinal opposite ends thereof U-like bent portions and spring portions extending from the bent portions, the spring portions being brought into contact with the push areas.

8. The device of claim 6, wherein each of the elastic bodies is formed of two or more leaf spring members, and wherein each of the leaf spring members has a U-like bent portion and a spring portion extending from the bent portion, the spring portion being brought into contact with the corresponding push area.

9. The device of claim 7, wherein each of the spring portions includes a first portion obliquely extending inward from of the corresponding bent portion and a second portion obliquely extending outward from the first portion, the second portion having a tip end making contact with each of the push areas.

10. The device of claim 8, wherein each of the spring portions includes a first portion obliquely extending inward from of the corresponding bent portion and a second portion obliquely extending outward from the first portion, the second portion having a tip end making contact with each of the push areas.

11. The device of claim 1, wherein the connection body includes two tip end portions to be inserted into the core of the wiring duct, the two tip end portions being arranged at the opposite sides thereof along the longitudinal direction, and wherein the contactors arranged in one of the tip end portions and the contactors arranged in the other tip end portion are electrically connected to each other by flexible electric conductors, respectively.

* * * * *